US006098984A

United States Patent [19]

Moore, Jr.

[11] Patent Number: 6,098,984

[45] **Date of Patent: *Aug. 8, 2000**

[54] METHOD OF PLAYING A CARD GAME

[76] Inventor: Naif Moore, Jr., 801 Regents Dr. E., Mobile, Ala. 36609

[ * ] Notice: This patent is subject to a terminal disclaimer.

[21] Appl. No.: 09/130,259

[22] Filed: Aug. 6, 1998

Related U.S. Application Data

[63] Continuation-in-part of application No. 08/845,784, Apr. 25, 1997, Pat. No. 5,865,437

[60] Provisional application No. 60/021,073, Mar. 27, 1996.

[51] Int. Cl.[7] ..... A63F 1/00

[52] U.S. Cl. ..... 273/292

[58] Field of Search ..... 273/292, 274; 463/13

[56] References Cited

U.S. PATENT DOCUMENTS

| | | | |
|---|---|---|---|
| 5,437,451 | 8/1995 | Fulton | 463/13 |
| 5,653,444 | 8/1997 | Dahl | 273/274 |
| 5,785,593 | 7/1998 | Wood et al. | 463/13 |

*Primary Examiner*—Benjamin H. Layno

[57] ABSTRACT

A card game as disclosed, wherein winning hands are determined by the four suits that make up a standard deck of 52 playing cards and wherein a winning hand has one card from each suit and further providing a novel way of determining winning hands and providing enhanced pay outs of winnings hands, as well as a table structure and video embodiment for playing the same. A jackpot is provided by having a statistically remote hand built from dealt cards combined with draw cards. In addition, a method is disclosed for playing multiple card hands to achieve the jackpot.

8 Claims, 7 Drawing Sheets

METHOD OF PLAYING A CARD GAME

PATENT HISTORY

This patent application is a continuation of the Provisional Patent filed Mar. 27, 1996 Provisional Filing No.: 60/021,073 and the Utility Patent filed Apr. 25, 1997 Utility Filing No.: 08/845,784 by Naif Moore, Jr., now U.S. Pat. No. 5,865,437.

GENERAL DESCRIPTION OF THE PREFERRED EMBODIMENT

The game described herein is a card game utilizing four cards, preferably having four different suits. Typically the four suits are diamonds, hearts, clubs and spades.

In the preferred embodiment, the primary steps of obtaining a winning hand is obtaining one card from each separate suit. In the preferred embodiment, each player starts with four cards and then has the option to discard and draw up to three draw cards. In the preferred embodiment, the discard is made by the player and afterwards three common cards are displayed in each of three separate locations corresponding to the first draw, the second draw and the third draw.

In other embodiments, the player (1) would not be restricted to the initial four cards, (2) be allowed to make a hand from the common draw cards, (3) obtain separate draw cards from a deck. While the preferred embodiment envisions a draw without additional wagers, an additional wager could be required before obtaining the draw cards. In the preferred embodiment, no additional wager is required in order to obtain the common draw, and the player can discard as many as three of the four original cards dealt. In other embodiments, the court could be limited to one, two or three draw cards.

A jackpot is described which allows for the house (generally a casino) to set up a progressive award. A progressive award allows for the house to increase the size of the jackpot until it is won by a single player.

In the other embodiment described herein, a related game is given a jackpot which allows for the house to allow the game to be played in a casino environment. The jackpot allows for the house to have juice which pays for the entire game which is otherwise a game among players. The benefit to providing this jackpot is to allow for the house to have poker type games without having to take a percentage or cut of the poker pot among players.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EMBODIMENT

Figure 1:
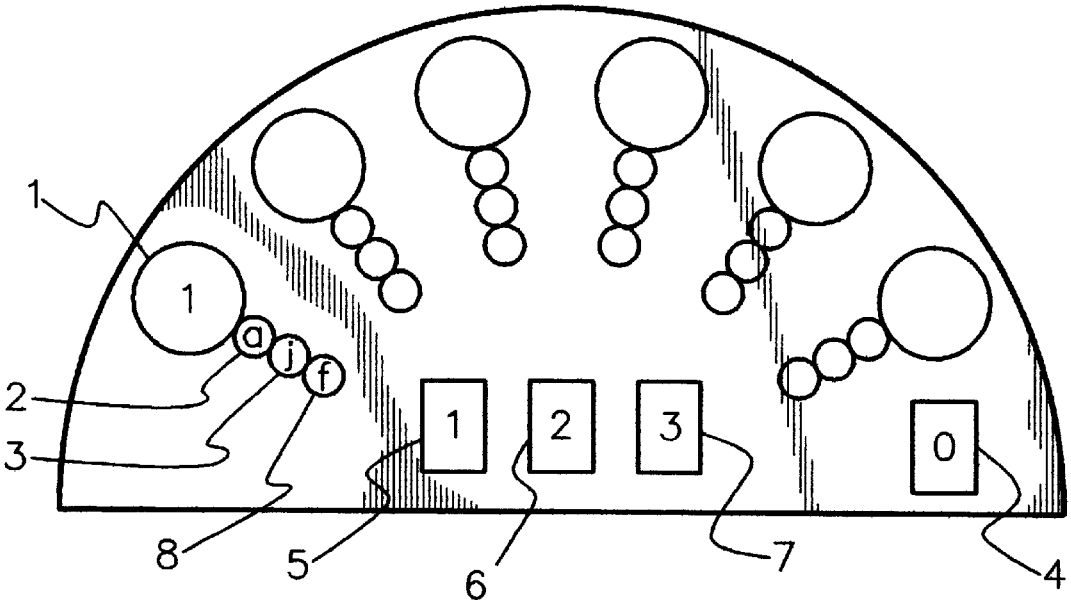
FIG. 1 is a plan view the table showing the play surface for the game.

In the preferred embodiment, shown on the table in FIG. 1, there are six player locations 1. Each player locations has an ante location 2 for an initial wager and a jackpot location 3 for placing bets to participate in higher pay outs described below.

The common draw comes from a three or four card hand dealt to the dealer. Where the dealer is dealt four cards, then the dealer discards one of the four cards in the discard location 4. The other three cards which he receives are designated as the first draw, second draw and third draw. The first draw goes on first draw location 5, the second draw on second draw location 6 and the third draw goes to third draw location 7. However, at this point, the draw cards on locations 5–7 are face down.

The players then makes their discards and the discards are collected by the dealer. The player's hands are then disclosed at their respective locations. A player having discarded one card, is only entitled to the first draw card, while the player having discarded two would use the first and second draw card from the dealer and the player who has discarded three cards would use the first, second and third draw cards. Without departing from the concept embodied herein, the dealer could be dealt a fourth draw card to allow players to draw an entirely new hand. In an alternate embodiment, to increase the level of skill, the player's hands could partially or completely be dealt up so that one player could see the hands of the of the five players before making a draw decision. Players could be dealt more than four cards (so that, for example, a traditional five card poker hand was held) but at least one card of each suit would still be required.

An additional feature of this game would be to allow or require the player to choose between a high and a low hand of novel composition. All winning hands would have to have the at least one card of each suit, sometime referred herein by the trademark "Rainbow".

In the preferred embodiment, the high winning hand would contain at least one nine card or higher card (with aces being low) from a tradition deck. An alternate embodiment would require the player to make a traditional hand with five cards and could require a pair or better. Another alternate using a four card hand would be to allow a payoff if all cards were of a single suit, also known as a flush, even though this would not be a hand with a card of each suit. This alternate winning combination would be an exception to the general rule, which general rule would require one card of each separate suit.

Where the rules require the player to choose between a high hand and a low hand (1) the player may be allowed to choose between a high hand and a low hand after seeing the draw cards or (2) the player may be required to make the choice between a high hand and a low hand before seeing the draw cards.

In order to add excitement to the game, an increasing pay out may be made where a better high hand or low hand is obtained in the same manner as in other jackpot type poker. In this way, for example, a four of a kind may have a large pay out where a 9 high 'rainbow' hand (a hand with one card of each suit) may only have an even money (one for one) pay out.

Similarly, a very low hand might have a bonus payout where, for example, the player had the one, two, three and four, all of a different suit. The specific odds on these pay outs would typically be governed by a function of the statistical odds of obtaining the particular hand in question.

All jackpot wagers would require the players place a wager on the jackpot location 3 in the preferred embodiment. The flush hand might require an additional wager on a separate flush location 8 shown in FIG. 1 to receive a flush payout.

An example of a list of the possible high hands and low hands (having one card of each suit) follows with the hands listed in order from highest payout to lowest payout:

All High hands must contain one card of each of the four suits and:

4 of a kind highest payout for high, 3 of a kind second highest payout, two pair third highest payout, one pair fourth highest payout, any hand 9 or higher without a pair or better being the lowest payout (e.g. even money or 3 to 2 in the preferred embodiment).

All low hand must contain one card of each of the four suits and:

a 4 high, having the highest payout, where four is highest card so that the cards are, necessarily the 1,2,3, and 4 of four different suits;

5 high having the second highest payout;

6 high third highest payout;

7 high forth highest payout;

8 high fifth highest payout (even money in the preferred embodiment—or 3/2).

Finally there is a provision for a non-Rainbow winning hand which may still have a payout, the flush.

The exact pay outs would vary, depending on the statistical pay out desired by the casino host.

An alternate method of determining winning hands and their relative pay outs would be to base the payout on the total value of the cards added together. For example, if all face cards were treated as having a value of 10 (the traditional valuation), then at ten, a queen, a nine and a king would total 39. Similarly, in this valuation, a statistically improbable hand (still containing one card of each suit) would be four of a kind. The lowest possible hand in value would be four aces if aces were low. This lowest possible hand would have a value of four. If pairs were treated differently, the lowest possible total would be the ace, two, three and four (for a total of 10) with one card being from each separate suit.

If jacks were treated as eleven, queens as twelve, kings as thirteen, and aces as high or low, than totaling high cards could also lead to statistically remote outcomes. For example, the ace, king, queen and jack (for a total of 50 if aces were treated as having a value of 14, for a total of 37 if aces were low only). Utilizing the statistical probability of each total, varying pay outs could be made based on this total.

The game as it's played, in the preferred embodiment, would involve the following steps:

The dealer would deal a hand to each player location where a player was located or, in the preferred embodiment, to all six locations. Each of these hands would be a four-card hand. Both the dealer and player hands would be dealt in private to each player in the low skill version. It an alternate embodiment, the cards, other than the draw cards, would be dealt face up to each player in the high skill version.

The dealer would deal himself at least three draw cards. To add excitement, in the preferred embodiment, the dealer would take three cards and a discard card so that his deal would be the same as the deal to the players. The players would then have an opportunity to view their cards in order to determine how many cards they wanted to draw.

In the preferred embodiment, all the players use the same draw cards, up to three. In alternate embodiments, the players could be dealt individual draw cards with awareness that the number of draw cards dealt must be less than the cards remaining in the deck. The game is played with a standard deck of cards, 52 playing cards, four suits (diamonds, hearts, spades and clubs), cards numbered ace through 10, jack, queen and king.

In the preferred embodiment, after the players hand made their discards, the cards would be gathered up and the dealer would make his discard from his top card. The remaining three cards would be put with the first card going on the first draw card location in front of the dealer, the second draw card going in the second draw card location in front of the dealer and the third card going into the third draw location in front of the dealer. The cards could be dealt manually or by electronic generation (as in a video game).

This game could be played with a shoe having a deck of cards, although in the preferred embodiment it is believed that it would be played with a single deck of cards. If the cards were dealt out of a shoe, the three draw cards could actually be drawn from the shoe after the discards were made and placed on the appropriate locations as they are drawn out of the shoe and if they were dealt out of a hand, they could be dealt out of the dealer's hand at this time. In order to build excitement, in the preferred embodiment, the draw cards are dealt ahead of time and put on the draw card locations ahead of time, so that the players are able to view the backs but not the values of the draw cards while making their decision as to what to discard.

After the players have made their decision and the discards have been gathered by the dealer, the hands are turned up to see the value of the hand and determine pay outs. Prior to this point, in the preferred embodiment, the players are not allowed to show their cards to one another.

At this time the dealer turns up the draw cards. The dealer then, starting at his left and moving across the table, makes the appropriate high hand or low hand with each of the players' hands, utilizing the draw cards which the dealer has to fill out the hand. Where the player has a losing hand, the wager and cards are collected. Where the player has a winning hand, the dealer returns after the other wagers are collected and cards removed and makes a payout, removing the winning hand cards upon making each payout to each player.

Figure 2:
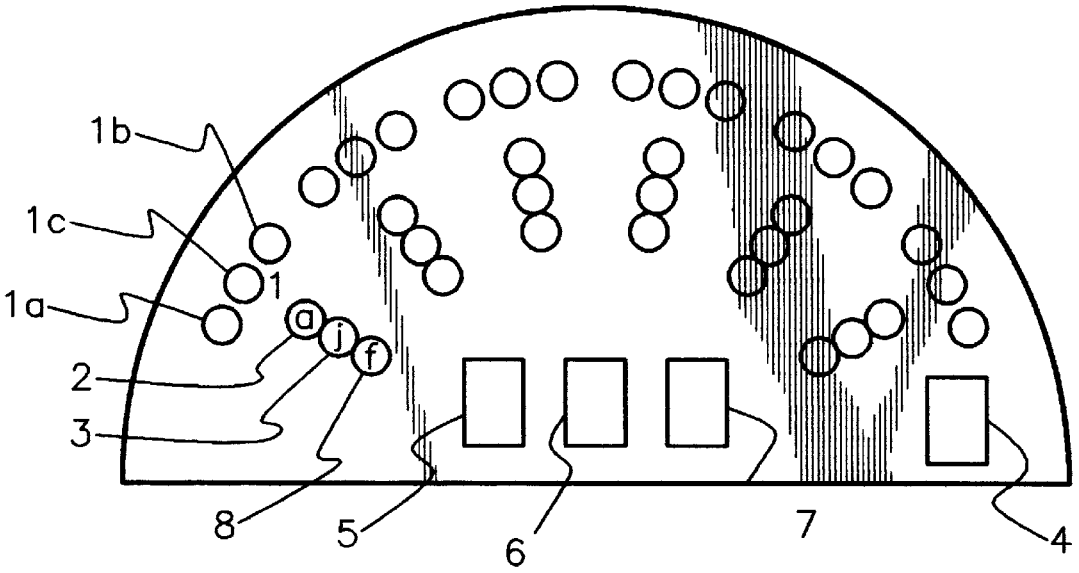
FIG. 2 is a alternate embodiment of the playing surface for the game.

In an alternate embodiment, the players would decide whether they had a high hand or a low hand. As shown in FIG. 2, this would require providing each player with a high location, 1*a,* a low location 1*b* and an either location 1*c* for either high or low. If the player played against the dealer, this choice may require the player's hand be higher or lower than the dealer's hand. The payout may be greater if the choice is made as compared to merely choosing either. Alternatively, the player's hand could be compared to another player's hand. Obviously, where they are required to pick a high or low hand first the player would be in a much more difficult playing environment, and in the preferred embodiment, they will be allowed to see the draw cards before making that choice. However, it could be provided that if the player chose between a high hand and a low hand before seeing the draw cards, they would have an enhanced payout. This is not present in the preferred embodiment.

In addition, in another alternate embodiment described in more detail below, the players would have at least one additional card, and they could elect to go high or low or both making up more than one hand.

In one alternative embodiment, the dealer would also have a hand dealt to him which could be used for two purposes:

It could be used as an opening hand, where if he didn't make a high hand or low hand with one card of each different suit, there would be no opening and it could also be used in order to play against the player's hands.

Where the dealer is playing against the players, cards without a complete rainbow could compete against one another. In one alternate embodiment, all four card rainbow hands (one card of each suit) would win over all three card (three suits in the hand out of the total of four suits) and all three card hands would win over two card hands (two suits in the hand out of the total of four suits).

In the preferred embodiment, the players are just playing to make the hand which they hold and they are not playing against the dealer and the only purpose of the cards before the dealer are to act as draw cards for the players.

Each player is paid if his hand is a winning hand and the proper wager has been made or his wager is collected as in appropriate.

While the four card poker game described, is the preferred method of playing the game, an alternate embodiment would be to have each player and the dealer each receive seven cards with which to make a two-card high hand and the best low hand possible, using traditional poker rules with the controlling factor for the high hand being that it must contain one card of each suit. In the preferred embodiment it would be a four card poker hand, but as can be seen, as long as there was one card of each suit, you could have a five-card poker hand and could even have a game where a fifth suit was required. In the preferred embodiment, there are only the four traditional card suits and the fifth card necessary for traditional poker is not required. High hand is won by the dealer in the preferred embodiment.

While this alternate embodiment concentrates on the high hand, the alternate embodiment, provides that the high hand be a two-card hand and concentrates on the low hand made up of four card in a rainbow (a rainbow being one card of each different suit).

This game would be much tougher to win, but since seven cards are available to the player it could be made possible.

In this embodiment, the player might be required to win either the high hand, the low hand, or both in order to receive a pay out or may receive a pay out for each hand made.

The highest hand in this second scenario, utilizing a two-card high hand and a four-card low hand rated from highest to lowest would be:

1. ace, two, three, four of different suits plus a pair of aces;
2. ace, two, three, four of different suits with any pair;
3. ace, two, three, four each of different suits without any pair.

A slot machine is envisioned which would utilize reels or video to display the player's four cards and allow a pay out whenever four cards of different suits were shown according to the rules described herein, with or without draw cards.

FIRST ALTERNATIVE RAINBOW POKER

Figure 3:
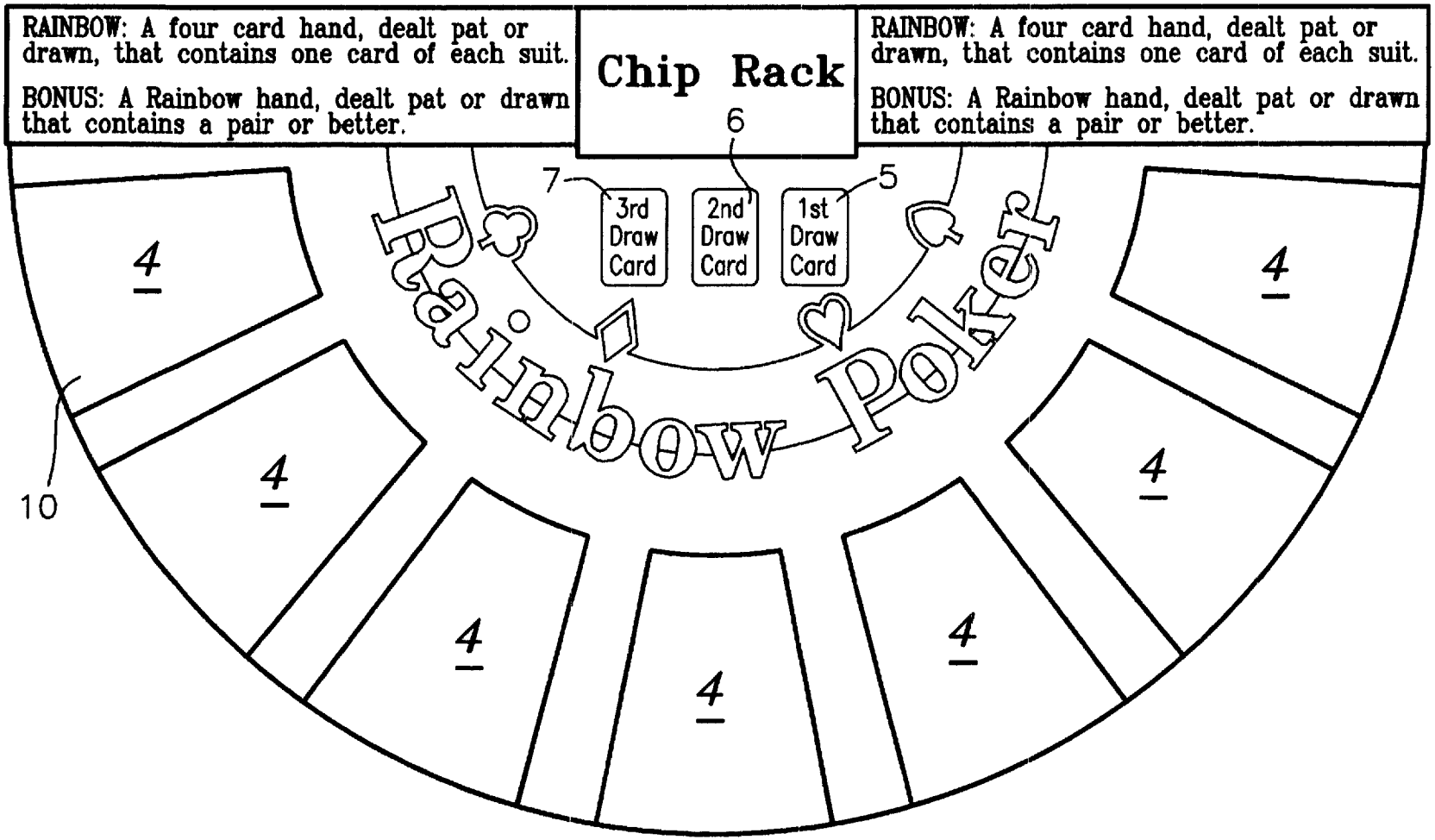
FIG. 3 is an alternate layout embodying a playing surface for the game.

FIG. 3 shows a first alternative version of the layout to play the game of rainbow poker. This unique version of poker can be played with a single standard deck of 52 playing cards or with multiple decks mixed together. The object of the game is to make a four card hand that contains a spade, heart, diamond, and club. All four card hands, be they dealt or draw that do contain one card of each suit, are winning Rainbow hands. To complete a Rainbow hand each player is allowed one draw of one, two, or three cards.

Figure 4:
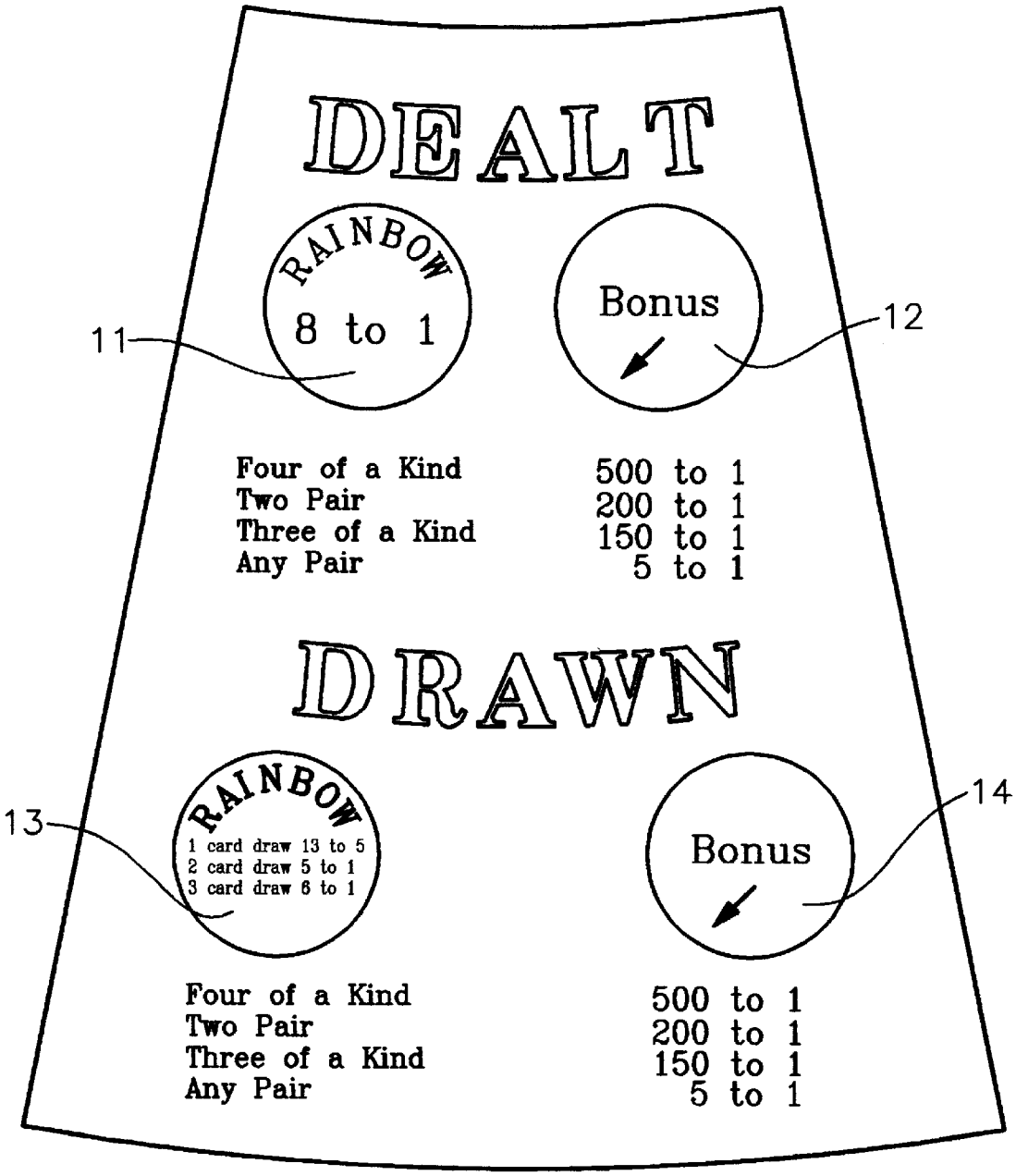
FIG. 4 is a detail of the alternative playing surface shown in FIG. 3

As shown on FIG. 4, which is a close up of the betting locations 10 shown on FIG. 3, four different betting locations are offered with this game, a dealt Rainbow spot 11, a bonus dealt spot 12, a draw rainbow spot 13 and a draw bonus 14. To make the game even more exciting, a location is available for each player to make a dealt 13 or draw bonus 14 bet.

Bonus bets, be they dealt or draw, are optional bets added to satisfy the lure of a jackpot payoff. In order for any bonus hand to be valid, it must contain one card of each suit. All wagering with this game must be made prior to a participant being dealt a hand. There are four possible wagers than can be made; two of these are mandatory while two are optional.

DEALT RAINBOW

This is a mandatory bet to qualify as a player. The sole determining factor as to the winning or losing of this bet is based on being dealt one card of each of the four suits. There is a standard payoff of 8 to 1 for this wager regardless of the poker hand that it contains. The house advantage with this feature is 5.1%, and each casino will determine the minimum and maximum bets allowed.

DEALT BONUS PAYOFF

| | |
|---|---|
| Four of a Kind | 500 to 1 |
| Two Pair | 200 to 1 |
| Three of a Kind | 150 to 1 |
| Any Pair | 50 to 1 |

Each casino will determine the minimum and maximum bets allowed.

DRAW RAINBOW

This also is mandatory bet that must be made prior to a player being dealt their hand. Once a player is dealt a hand that does not contain one card of each suit they automatically have action on this feature. One draw of 1,2, or 3 cards is allowed in order to complete a draw Rainbow hand. To win, that four card hand must consist of one card each of the four suits. In the event a player is dealt a pat Rainbow, the money bet on this feature is deemed no action and returned to the player. The amount of money bet on this feature does not have to be the same amount bet on the dealt Rainbow. It only has to be within the minimum and maximum betting limits offered by the participating casino. The house advantage on this feature is 4.6%.

DRAW RAINBOW PAYOFF

| | |
|---|---|
| One Card Draw | 13 to 5 |
| Two Card Draw | 5 to 1 |
| Three Card Draw | 6 to 1 |

DRAW BONUS

This is an optional bet where the payoff is determined by the poker hand contained within the draw Rainbow hand. In order for the draw bonus payoff to be valid, it must be bet prior to receiving the initial four cards and must contain one card of each suit. In the event a player is dealt a pat Rainbow, the money bet on this feature is deemed no action and returned to the player.

DRAW BONUS PAYOFF

| | |
|---|---|
| Four of a Kind | 250 to 1 |
| Two Pair | 50 to 1 |
| Three of a Kind | 20 to 1 |
| Any Pair | 3 to 1 |

The house advantage on this feature is 4.1%

RULES AND PROCEDURES

1. To qualify as a participant, a mandatory bet is required on both dealt and draw Rainbow.
2. Different amounts can be bet on each as long as it is within the minimum and maximum allowed by each casino.

JACKPOT BONUS

In order to obtain a jackpot type bonus payout that in creases over time, a percentage of the bonus wagers or other wagers may be put into a growing jackpot type payout or may be used to offset a large payout jackpot.

In order to maintain statistical consistency, this jackpot must be more difficult than the other wagers allowed, but must still fall within the same set of wagers. In order to make this possible, the jackpot may be a function of a draw bonus having a certain four cards where at least one of the cards, and possibly a specific card, came from the draw cards. To illustrate how this would be possible, the following example is used.

The jackpot would receive a certain number of cents from each draw bonus bet, thereby reducing the draw payouts to cover this jackpot. The jackpot could be four aces where three aces come from the dealer's draw cards. In this example, if the drawn bonus hand was one having four aces, but the player had three aces in his hand and one from the draw cards the player could receive 10% (or some other predetermined percentage) of the jackpot. If the player had two aces and drew two aces from the draw cards, the player could receive 20% (or some other predetermined percentage) of the jackpot. Finally, if the player drew three aces and had one ace in his hand, he would receive the entire jackpot.

Likewise, the jackpot could be based on drawing a particular card from the draw cards. Using the example above, the jackpot could occur where the player drew a single card from the draw cards in order to complete four aces and the specific card was the ace of spades. Similarly, where the one draw card was the ace of diamonds, the hand could pay 10% of the pot, where it was the ace of clubs, 20% of the pot, where it was the ace of hearts, 30% of the pot and where it was the ace of spades 100% of the pot. Alternatively, it could be based on two cards from the draw being specified. In this example, the ace of clubs and the ace of hearts would provide one percentage of the jackpot and the ace of clubs and ace of diamonds might provide for another jackpot. While aces are used in this example, the game could make jackpot awards based on other four of a kind combinations where some of the cards or at least three came from the draw or the game could make the jackpot awards based upon any four of a kind combination where some or at least three of the kind came from the draw. Or the jackpot could be more specific as where the player would need to draw two cards and the only two allowed were the ace of spades and the ace of diamonds. While four of a kind is used in this example, the bonus could be a straight or other combination as long as the jackpot payout is based upon the draw of certain cards or combinations.

Even if players could make multiple hands to obtain all or part of the jackpot, this jackpot would build because it's outcome would be statistically less likely, thereby justifying the jackpot, because players would not (or could be prevented by game rules) from throwing away a non-bonus hand to obtain the possible jackpot. In fact, even if players elected to throw away hands in order to obtain the possible jackpot, this would still work, since that would decrease payout possibilities for that player.

A special location may be made to wager on this jackpot, but the preferred embodiment envisions that this jackpot would come from wagers on the dealt and draw bonus wagers.

In the preferred embodiment, this is strictly a 4 card poker game played with a regular deck of 52 cards containing four suites. It also could be played by having colors substituting for suites.

YOU WIN-I WIN-YOU WIN

Prior Art: Chinese Poker Rules

Figure 5:
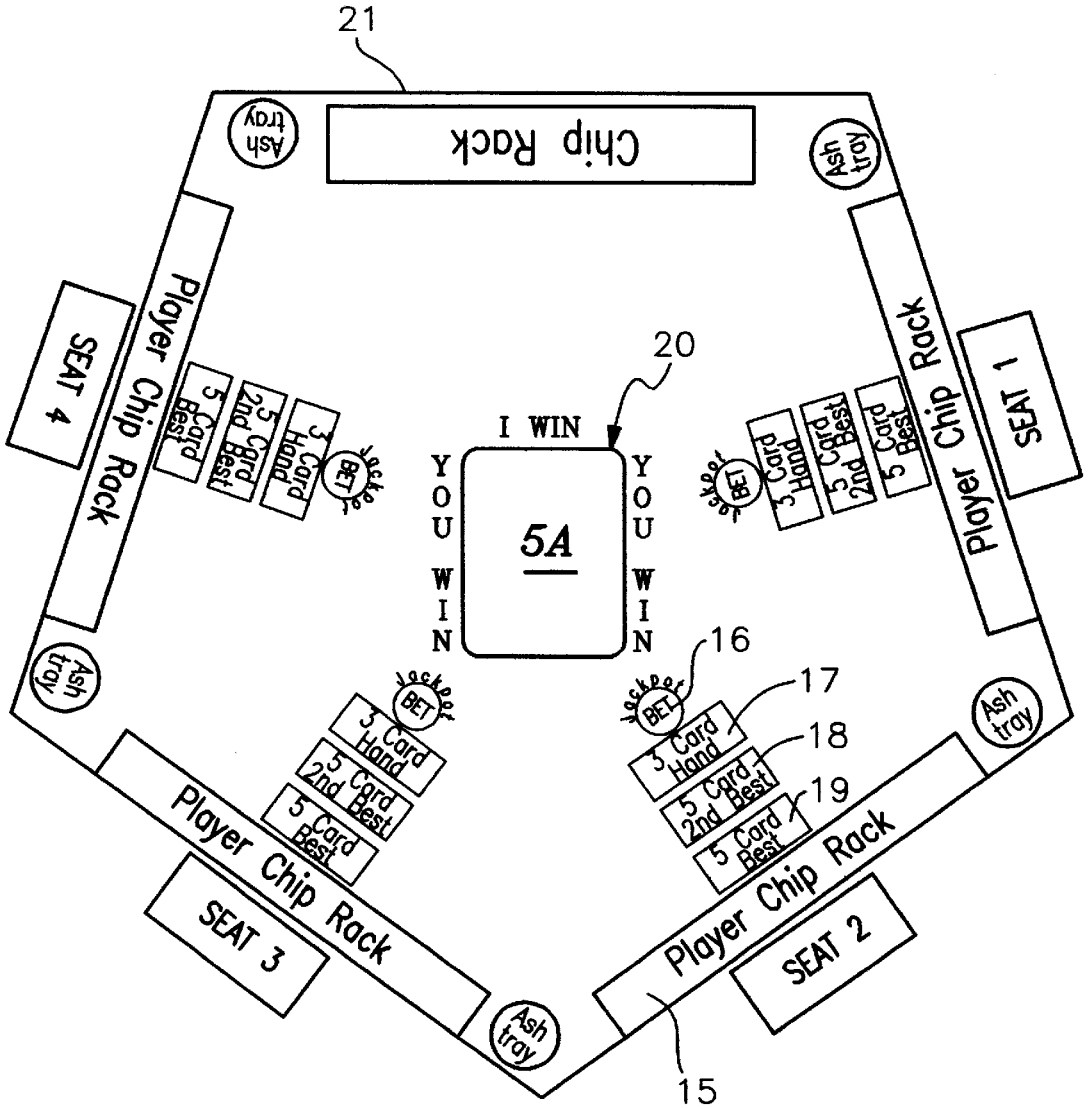
FIG. 5 is an alternative game providing a jackpot utilizing multiple hands instead of multiple wagers.
Figure 5A:
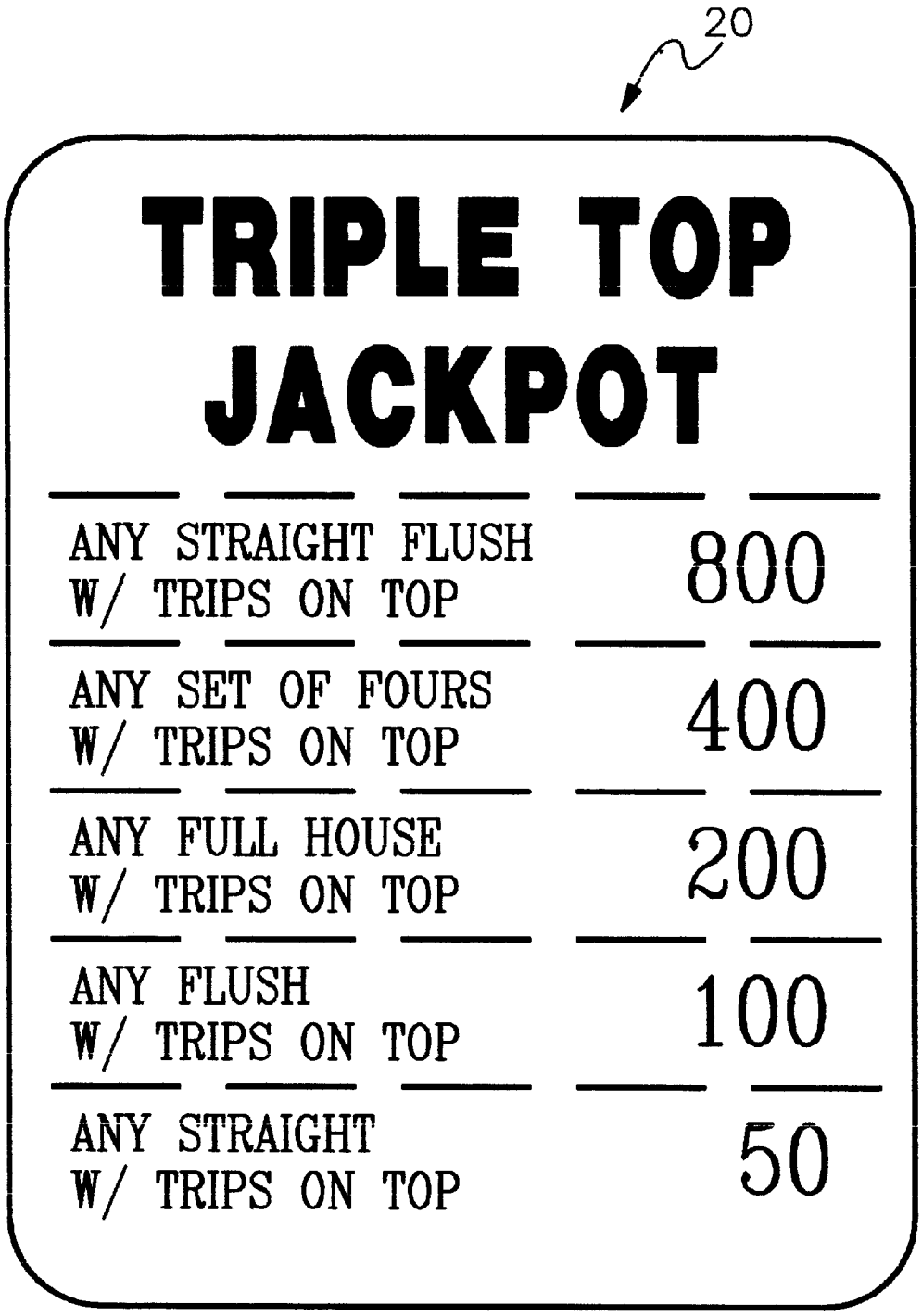
FIG. 5*a* is a detail of item number 20 shown in FIGS. 5 and 6.

Chinese Poker is similar to Pai Gow Poker. Each player is dealt 13 cards. These 13 cards are set into three poker hands: a 3-card front hand, a 5-card middle hand and a 5-card back hand. Straights and flushes do not count in the 3-card hand. The front hand must not be stronger than the middle hand and the middle hand must not be stronger than the bank hand. There is no betting or folding. Once everyone's hands are set, the showdown occurs. You compete against each player individually, comparing, your respective hands. For each hand you win, your opponent pays you one point. For each hand you lose, you pay one point. The player with more wins is paid a bonus point. If any player "fouls" their hand (by violating the rule that the front must be weaker than the middle, and so on), they pay four point to each opponent. A modified version of Chinese Poker is shown in FIG. 5.

Prior art continued: ROYALTIES (also called "Bonus Points") IN CHINESE POKER

Royalties are special bonuses paid to the holders of particular hands. They may be paid even if the hand loses, although a compensating royalty will then be paid in return. Royalties are not paid by players who surrender. The standard royalties are

| | Back | Middle | Front |
|---|---|---|---|
| Trips | 0 | 0 | 2 |
| Full House | 0 | 1 | — |
| Quads | 3 | 3 | — |
| Straight Flush | 4 | 4 | — |
| Royal Flush | 5 | 5 | — |

Prior art continued: SURRENDER

The surrender option has three variants. In real life, it is usually played "declare in turn", starting with the player to the left of the button. Each player says in order whether they wish to surrender. If so, that player will pay each active player two point at the showdown. A variant is "declare at random", in which any player can surrender at any time before the showdown, but the decision is irrevocable. The final variation is "secret declare", in which each player simultaneously declares their intentions.

Another variation often played in the real world but not available on IRC is similar to the "declare in turn" method above. However, when a player surrenders, that player pays two points only to the players that have yet to act.

Prior art continued: LOWBALL

In the lowball variants of Chinese Poker the middle hands compete for the best low. The middle hand is completely independent of the front and back hands; it can be weaker or stronger than either. The bank hand must still be stronger than the front hand. In ace-to-five lowball, straights and flushes don't count against the low and the best hand is a 5432A. In deuce-to-seven lowball, straights and flushes do count, the ace is high, and the best low is 75432 of mixed suits.

If royalties are also in effect, they are adjusted as follows:

Prior art continued: Deuce-to Seven Lowball Royalties

When the middle hand is played for deuce-to-seven lowball, the following royalties are used:

| | Back | Middle | Front |
|---|---|---|---|
| Five Low | — | 1 | — |
| Trip Eights | 0 | — | 1 |
| Quads | 1 | — | — |
| Straight Flush | 2 | — | — |
| Royal Flush | 3 | — | — |

Prior art continued: Ace-to-Five Lowball Royalties

When the middle hand is played for ace-to-five lowball, the following royalties are used:

| | Back | Middle | Front |
|---|---|---|---|
| Five Low | — | 1 | — |
| Trip Eights | 0 | — | 1 |
| Quads | 1 | — | — |
| Straight Flush | 2 | — | — |
| Royal Flush | 3 | — | — |

Prior Art Continued: DOUBLE DECK

Chinese Poker can be play with two decks, but the new distribution of cards requires a different ranking of hands. Also, three hands are added that are impossible in single-deck games: five of a kind, flush with two pair, and flush with one pair. The revised rankings are 3. five of a kind
4. straight flush
5. two pair flush
6. four of a kind
5. one pair flush
6. flush
7. full house
8. straight
9. three of a kind
10. two pair
11. one pair
12. zilch Flushes with pairs are ranked the same as regular hands with pairs, e.g., 88552s beats 6633as and 33654s beats 22AKQs.

Again, royalties must be adjusted for the new rankings:

Prior art continued: DOUBLE DECK ROYALTIES

With two deck rankings, the following royalties are used:

| | Back | Middle | Front |
|---|---|---|---|
| Trips | 0 | 0 | 1 |
| Pair Flush | 0 | 1 | — |
| Four of a Kind | 0 | 2 | — |
| Two Pair Flush | 0 | 3 | — |
| Straight Flush | 1 | 4 | — |
| Five of a Kind | 2 | 5 | — |

Prior art continued: DOUBLE DECK DEUCE-TO-SEVEN LOWBALL ROYALTIES

With two deck rankings and the middle hand played for deuce-to-seven lowball, the following royalties are used:

| | Back | Middle | Front |
|---|---|---|---|
| Seven-Five Low | — | 1 | — |
| Trip Aces | 0 | — | 1 |
| Straight Flush | 1 | — | — |
| Five of a Kind | 2 | — | — |

YOU WIN-I WIN-YOU WIN

Players rotate the deal in traditional Chinese poker. Here, the house provides the dealer. A jackpot bet is added to the play, paid by the house. The house has an advantage earned by the jackpot. In addition, the house provides a guarantee based on ten times the base wager which is paid to the house. A bonus payout is provided for at least the best hand, and possibly for all hands that have a bonus.

The invention referred to herein as You Win-I Win-You win is a variation of Chinese Poker that can be played with two, three or four participants competing against each other. The skill of the game is based on a participants ability to display common sense poker knowledge when conceiving three different poker hands out of the 13 cards dealt each participant in accord with the rules set out in the prior art game of Chinese Poker. Because this game is designed to be played in a casino environment, each player must establish a bank roll for the house which can be used to cover all of the wagers when the player loses or refuses to use his personal bankroll. In order to finance this, the house must obtain ten times the base wager which the house can then guarantee.

As can best be seen by reference to FIG. 5, in the preferred embodiment, there are four seats. A dealer may be provided by the casino at a fifth side 21 of an octagonal table layout 22. The house advantage or juice comes from a jackpot bet made at a jackpot location 16. Where only a single player is available, the house may take one of the empty seats as the house hand and play against a player or the table may remain closed until additional players arrive. Since this later situation is the preferred method of play, this game requires two players who consent to compete against one another in this embodiment. If more than one persons are at the table, the two persons may play against one another. Likewise, the table could always have a house hand.

Each player is required to make two 5 card and one 3 card hand out of their 13 cards. The 5 card hand placed on the bottom spot 19 must be the best poker hand while the 5 card middle hand on the middle spot 28 must be better than the 3 card top hand made at the top spot 17. Arranging the 13 cards dealt offer a variety of combinations from which to choose allowing participants to be the master of their own fate. Each of the three poker hands represents a separate wager with all other participants, the amount wagered on each of the three hands is equal and predetermined.

Players are required to make a one dollar triple top jackpot bet at jackpot location 16 with each set of competing hands. The dealer instructs players not to place this bet until they have their hands set to their liking. Placing this bet acknowledges to the other participants their hands are set and ready for display.

The payout is between individual players. For example all the players in turn would settle with player one, then the remaining three would settle, three and four settling with two and finally players three and four would settle. The house would audit this settlement.

TRIPLE TOP JACKPOT

To be a Triple Top Jackpot winner the top three card hand must contain a set of trips and still be the worst of the three pokers hands set. This additional wager is collected or paid by the dealer and is independent of player competition. A predetermined percent of this wager is paid to participants who qualify with a winning jackpot hand.

As shown at the payout rule location 20, the player may obtain jackpot payouts, financed by the jackpot bet 16 for a Straight Flush (800 to 1); a Set of Four card with three of a kind at the top would payout 400 to 1; a Full House with three of a kind on top 200 to 1; any Flush with three of a kind on top paying 100 to one; and any Straight with a set of trips 50 to one.

The concept being that the key is tying the better hand to a statistically remote hand on the top, here the most statistically remote hand is considered three or a kind (also known as trips).

RULES OF PLAY

1. Players may arrange the 13 cards dealt them in any matter of mixture they choose as long as:
   (a) The bottom five cards contain a better poker hand than the middle or top hand.
   (b) The middle five card hand contains a better poker hand then the three card top hand.
   (c) The top three card hand contains the worst of the three pokers hands.
2. Each player acknowledges their hands are set and ready for display by placing their $1.00 triple top jackpot bet. Once a player does this they are committed to turn over all three hands as they are set. In the event the hands are mislaid the dealer will rearrange the positions of the three hands. No cards can be interchanged between the three hands except by the dealer once the hands have bet set.
3. Wagering on Competing Hands:
   (a) Each competing hand represents a separate bet.
   (b) Each hand competes against all other participants hands positioned in the same location.
   (c) Each of the three hands are equal in value bet.
   (d) An extra point is awarded to the winner of the most hands examples: Winner of two out of three hands wins two bets. Winner of all three hands wins four bets. When a win, loss and a tie hand occurs no extra point is awarded.
   (e) Bonus points are awarded afterwards.
4. Bonus Points or Royalties

| | |
|---|---|
| (a) Bonus points (Royalties) are awarded only to the winning hand. | |
| (b) Any Straight Flush | 4 Extra Points |
| (c) Any Four of A Kind | 3 Extra Points |
| (d) Any Trips On Top | 2 Extra Points |
| (e) Any Full House In The Middle | 1 Extra Point |

5. Because the house would not, in the preferred embodiment, play a hand, the minimum number of players would be Two. In order to keep the game manageable, it is envisioned that the maximum number of players would be Four, but this is an optional number. Because the game is designed around not taking a part of the pot, a mandatory $1.00 Triple Top Jackpot bet is required. Typically, a minimum, such as a $2.00 bet per hand point, is guaranteed by casino which is insured with the ten times the minimum paid by the player before play is begun. Any additional wagering between players is done at players risk without a guarantee by the house. The house may require additional amounts to be put up for certain players to ensure they cover these additional wagers. After all hands are exposed the dealer will verify the outcome for each participant.

The preferred embodiment provides the charge, or house juice, to be based roughly on 50% of True Odds on the Triple Jackpot wagers. The minimum amount bet per point is typically determined by the starting players of each table. This allows for high rollers to enjoy the game as well as low wager players. The house may set a minimum and maximum bet per point.

The casino would only guarantee bets are paid based upon the minimums and these would be insured by requiring players to post with dealer. While in the preferred embodiment, the players would only need to post ten times the amount bet per point, the house could set the standard according to other criteria.

This game would probably be most effective in the poker room for players waiting for full poker games or games with additional players.

The game attracts poker players to casino and allows for no more than two players to be entertained while waiting for a poker game of their liking to start. Typically, where the game is played, the casino earns $40.00 per table per hour. This creates additional earnings for standby dealers.

A progressive jackpot may also be provided based on having a specific combination of hands which would not be likely. The example of this is similar to that described above for the rainbow poker game. In one example, the jackpot could be based on having two sets of four of a kind along with trips on top. This would add excitement to the game as well as encouraging more players to play this game preferentially to other poker games available.

Figure 6:
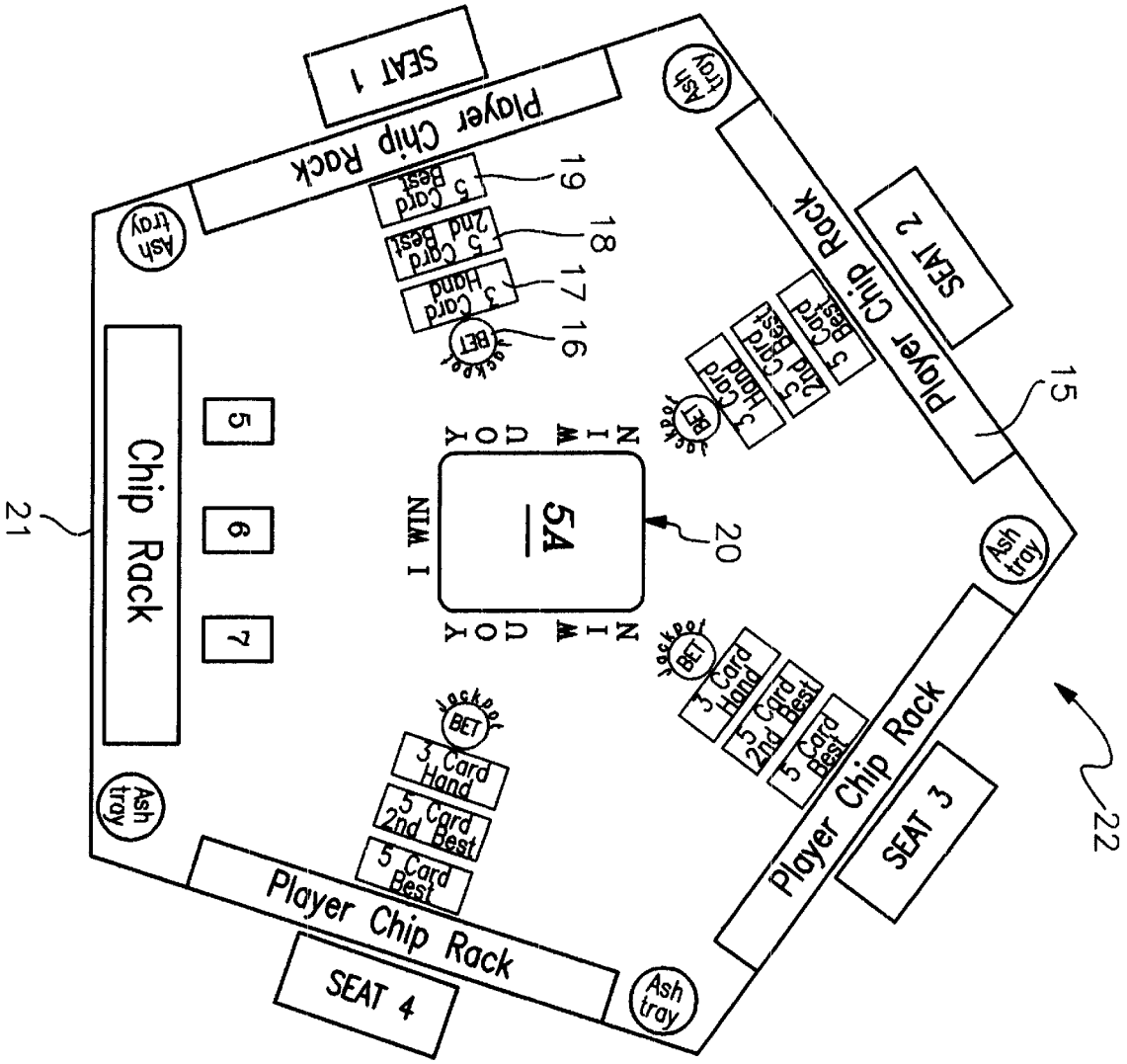
FIG. 6 is a modification of FIG. 5 showing how a rainbow poker hand can be played.

Finally, using the four card scenario outline above, the players could play a game where each player receives one less card on the deal and may draw from a dealer hand have three draw cards 5, 6 and 7 as shown in FIG. 6. This game is otherwise played as a four card poker game or a rainbow four card poker game according to the rules set out herein, except where the bonus varies according to the house rules for four card poker. In this way, to have any opening hand, players would be required to make at least one of the three hands (it may be specified which of the two as in this example) a rainbow hand. Likewise, only one of the three hands need be based on a rainbow hand. For example, the high hand could be the highest hand and could be five cards with the second best hand only qualifying if it were a rainbow hand and even being as few as four cards. Similarly, the three card hand might be required to be a rainbow of any variety instead of a 3 of a kind rainbow hand.

Because of the nature of the rainbow card game described herein, it would probably be necessary for the rainbow game to be played with four of the cards and with these being dedicated to the rainbow hand by the dealer and three of the cards being dedicated to the draw before any of the other cards, for the other two hands, were sorted by the players. When the three card hand 17 was to be a rainbow you might have 3 draw cards and a fourth card which would go to making the fourth card for the three card hand 17 rainbow. It should be noted that this unlikely arrangement would potentially be impossible with a 52 card single deck because of the possibility of running out of cards.

The four card hand could be played with one player against the other, as with traditional Chinese poker, but would preferably be a hand which only was played against the house.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. A method of playing a game utilizing a card means comprising a plurality of cards and wherein said plurality of cards is comprised of at least four separate suits comprising the steps of:

a) generating at least one player hand to be held by a player said hand having at least one card for each of the at least four suits;

b) defining at least one winning hand comprising the at least one player hand containing at least one card of each of the at least four separate suits;

c) providing at least one payout for the at least one winning hand and wherein the payoff increases according to the statistical difficulty in making the at least one player hand and further comprising;

d) establishing at least one bonus hand comprised of a specific combination of four cards;

e) allowing the player to draw at least one card in order to establish a winning hand;

f) allowing for an enhanced payout based on the statistical difficulty of obtaining the bonus hand of four cards from a combination, said combination being:

i) at least one card of the bonus combination from the players hand and ii) at least one card of the bonus combination from a draw hand.

2. The invention of claim 1 wherein the game further comprises the steps of:

a) allowing a wager that the player will receive one card from every suit on the deal;

b) allowing a wager that the player will receive a jackpot hand consisting of one hand chosen from the group of poker hands consisting of a pair, two pair, three of a kind, a straight and four of a kind on the deal;

c) allowing a wager that the player will receive a card from every suit from at least one draw of a predetermined maximum number of cards;

d) allowing a wager that a jackpot hand chosen from the group of poker hands consisting of a pair, two pair, three of a kind, a straight and four of a kind will be received from the at least one draw;

e) making at least one payout for winning at least one of the wagers made.

3. The invention of claim 1 wherein there are at least two bonus hands and wherein one bonus hand receives a smaller payout than the other based on the statistical difficulty associated with one versus the other.

4. The invention of claim 3 further comprising the step of establishing a progressive wager having a progressive or enhanced jackpot based on achieving a progressive hand, said progressive hand being a jackpot hand having at least one card in the jackpot hand coming from the draw.

5. The invention of claim 4 wherein the progressive hand has at least two cards come from the draw.

6. The invention of claim 4 wherein the progressive hand has at least one predetermined card necessary for the jackpot hand must come from the draw.

7. The invention of claim 6 wherein at least two predetermined cards can make the progressive hand, but wherein the size or percentage of the progressive jackpot varies depending on which of the at least two predetermined cards comes from the draw.

8. The invention of claim 6 wherein at least two predetermined cards can make the progressive hand, but wherein the size or percentage of the progressive jackpot varies depending on how many of the predetermined cards come from the draw.

* * * * *